US006431947B1

(12) United States Patent
Henz

(10) Patent No.: US 6,431,947 B1
(45) Date of Patent: Aug. 13, 2002

(54) FALL-AWAY BRASSIERE

(76) Inventor: Michael J. Henz, 101 Cheek St., Carrboro, NC (US) 27510

( * ) Notice: Subject to any disclaimer, the term of this patent is extended or adjusted under 35 U.S.C. 154(b) by 0 days.

(21) Appl. No.: 09/615,885

(22) Filed: Jul. 14, 2000

(51) Int. Cl.[7] ..... A41C 3/00
(52) U.S. Cl. ..... 450/86; 450/88
(58) Field of Search ..... 2/113, 67; 450/1, 450/58, 59, 64, 71, 78, 79, 80, 82, 86, 87, 88, 62, 73, 77, 8, 9, 10, 14, 17, 18, 26, 28; D2/706, 707, 708, 709

(56) References Cited

U.S. PATENT DOCUMENTS

| | | | | | |
|---|---|---|---|---|---|
| 525,241 | A | * | 8/1894 | Tucek | |
| 1,878,755 | A | * | 9/1932 | Caldor | |
| 1,926,078 | A | * | 9/1933 | Yonts | 2/42 |
| 2,055,094 | A | * | 9/1936 | Zweben | 2/42 |
| 2,134,294 | A | * | 10/1938 | Yerkes | 2/42 |
| 2,156,478 | A | * | 5/1939 | Kemp | 2/42 |
| 2,255,720 | A | * | 9/1941 | Lewis | 2/42 |
| 2,438,210 | A | * | 3/1948 | Gluckin | 2/42 |
| 2,454,152 | A | * | 11/1948 | Glick | 2/42 |
| 2,455,036 | A | * | 11/1948 | Boylan | 2/42 |
| 2,954,031 | A | | 9/1960 | Froehlich | 128/472 |
| 3,008,468 | A | * | 11/1961 | Williams | 128/426 |
| 3,027,898 | A | * | 4/1962 | Williams | 128/510 |
| 3,204,638 | A | | 9/1965 | Winkler | 128/502 |
| 3,311,112 | A | * | 3/1967 | Murray | 128/425 |
| 3,935,865 | A | * | 2/1976 | Newmar | 128/488 |
| 3,982,547 | A | * | 9/1976 | Walker | 128/452 |
| 4,418,696 | A | | 12/1983 | Delet | 128/476 |
| 4,957,466 | A | * | 9/1990 | Hopps | 450/85 |
| 5,024,628 | A | * | 6/1991 | Sanchez | 450/36 |
| 5,538,502 | A | * | 7/1996 | Johnstone | 602/79 |
| 5,911,618 | A | * | 6/1999 | Dailey | 450/86 |
| 6,023,785 | A | * | 2/2000 | Johnson | 2/62 |
| 6,110,007 | A | * | 8/2000 | Rittmann | 450/86 |
| 6,155,906 | A | * | 12/2000 | May | 450/88 |
| 6,179,687 | B1 | * | 1/2001 | Lee et al. | 450/88 |
| 6,186,861 | B1 | * | 2/2001 | Flaherty | 450/1 |

* cited by examiner

*Primary Examiner*—Gloria M. Hale
*Assistant Examiner*—Alissa L Hoey
(74) *Attorney, Agent, or Firm*—Olive & Olive, P.A.

(57) ABSTRACT

A full-support brassiere that can be removed without the need to first remove outer garments such as a blouse. The Fall-Away Brassiere is designed with shoulder straps for support and comfort. The release of a single fastener, releases both the back band and the shoulder straps, allowing the brassiere to fall-away from the wearer's body. The wearer can then slip the brassiere out from under her blouse.

10 Claims, 10 Drawing Sheets

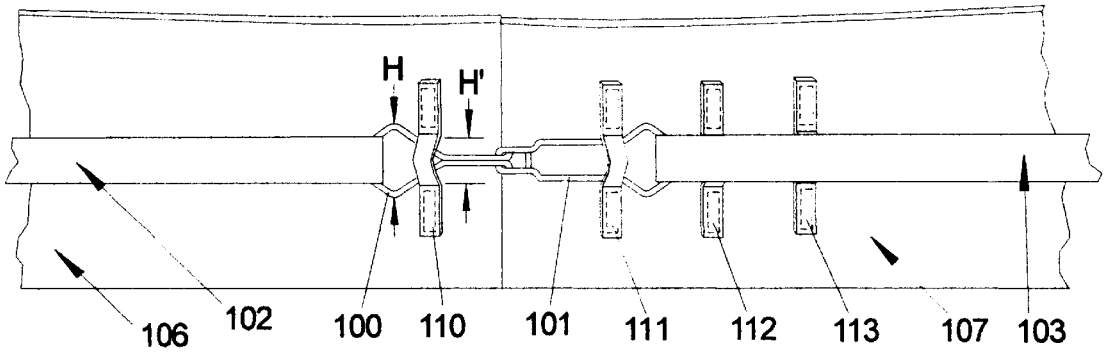
FIG. 2A
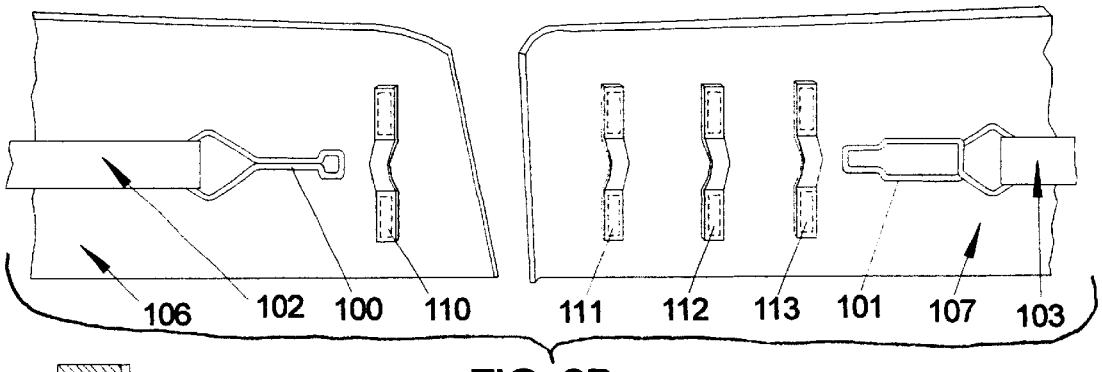
FIG. 2B
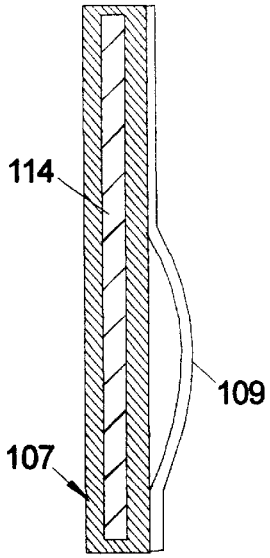
FIG. 3
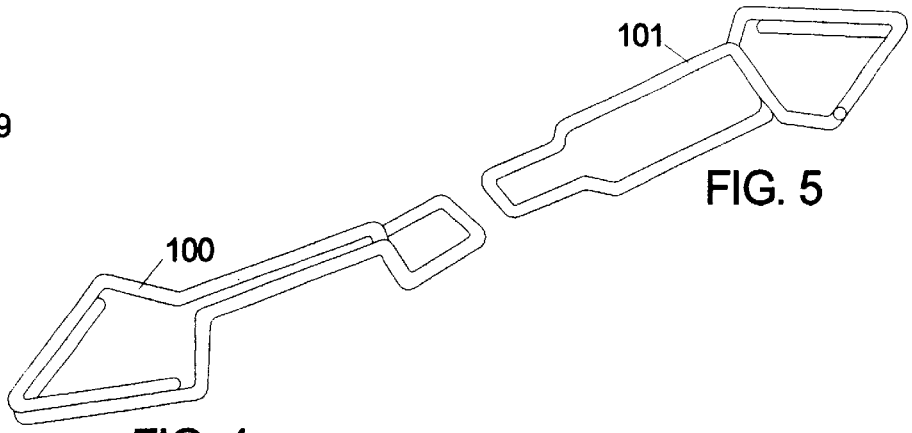
FIG. 5
FIG. 4

FALL-AWAY BRASSIERE

FIELD OF THE INVENTION

The invention relates to brassieres, specifically to the attachment and the release of the shoulder straps and back band.

BACKGROUND OF THE INVENTION

Brassieres are generally worn to provide support for the breast. The full-support brassiere (brassiere with shoulder straps) is designed specifically for this purpose. While the full-support brassiere serves its intended purpose, it is difficult to remove quickly, either for practical purposes or in moments of passion, and nearly impossible to remove without first removing the outer garments.

Several prior inventions have attempted to address this limitation. U.S. Pat. No. 2,954,031 to Froehlich describes a front-opening strapless brassiere. While the front-opening strapless brassiere described by Froelich can be removed quickly without the need to first remove outer garments, the strapless brassiere does not provide the same level of support and comfort found in brassieres with shoulder straps. Likewise, U.S. Pat. No. 4,418,696 to Delet describes a backless brassiere for use with low cut dresses. The Delet invention does not solve the removal issue, since the backless brassiere described still employs shoulder straps. Rapid removal of the brassiere described by Delet would still be problematic, and require the removal of outer garments to slide the brassiere off the shoulders. U.S. Pat. No. 3,204,638 to Winkler describes a backless-strapless brassiere. While removal may be simple, the backless-strapless brassiere provides inadequate support, and is generally reserved for formal dresses with both low cut backs and exposed shoulders.

The desire for a full support brassiere that can be quickly and easily removed is evidenced by the popularity of the front-opening brassiere. However, as with any full-support brassiere commercially available that employs shoulder straps, the front-opening brassiere can not be removed from the shoulders without first removing the outer garments.

SUMMARY OF THE INVENTION

Accordingly, objects and advantages of the present invention are:

(a) to provide a full-support brassiere that employs shoulder straps for comfort and support; and (b) to provide a full-support brassiere that can be quickly and simply removed without the necessity of first removing the outer garment such as a blouse.

Further objects and advantages of the invention will become apparent through consideration of the drawings and ensuing description.

Unlike the prior art, which sacrificed function for form or visa versa, the Fall-Away Brassiere disclosed below incorporates both comfort and support with ease of removal. The use of either a common attachment point for both the back band and the shoulder straps, or a remote coupling device for the shoulder straps that releases when the back band is unfastened, makes this possible.

BRIEF DESCRIPTION OF THE DRAWINGS

FIGS. 2A and 2B show an enlarged, fragmentary, detailed view of the back bands and shoulder straps for the rear-opening Fall-Away Brassiere in the fastened and unfastened conditions respectively.

FIG. 3 is a sectional view, indicated by the section lines 3—3 in FIG. 1A, of the back band for the rear-opening Fall-Away Brassiere showing the rigid member that spans the back band to prevent bunching of the back band.

FIG. 4 is an enlarged perspective view that shows the detail for a low-snag hook for use with the rear-opening Fall-Away Brassiere.

FIG. 5 is a perspective view that shows the detail for a low-snag eye for use in conjunction with the low-snag hook of FIG. 4 with the rear-opening Fall-Away Brassiere.

DETAILED DESCRIPTION OF INVENTION

Figure 1A:
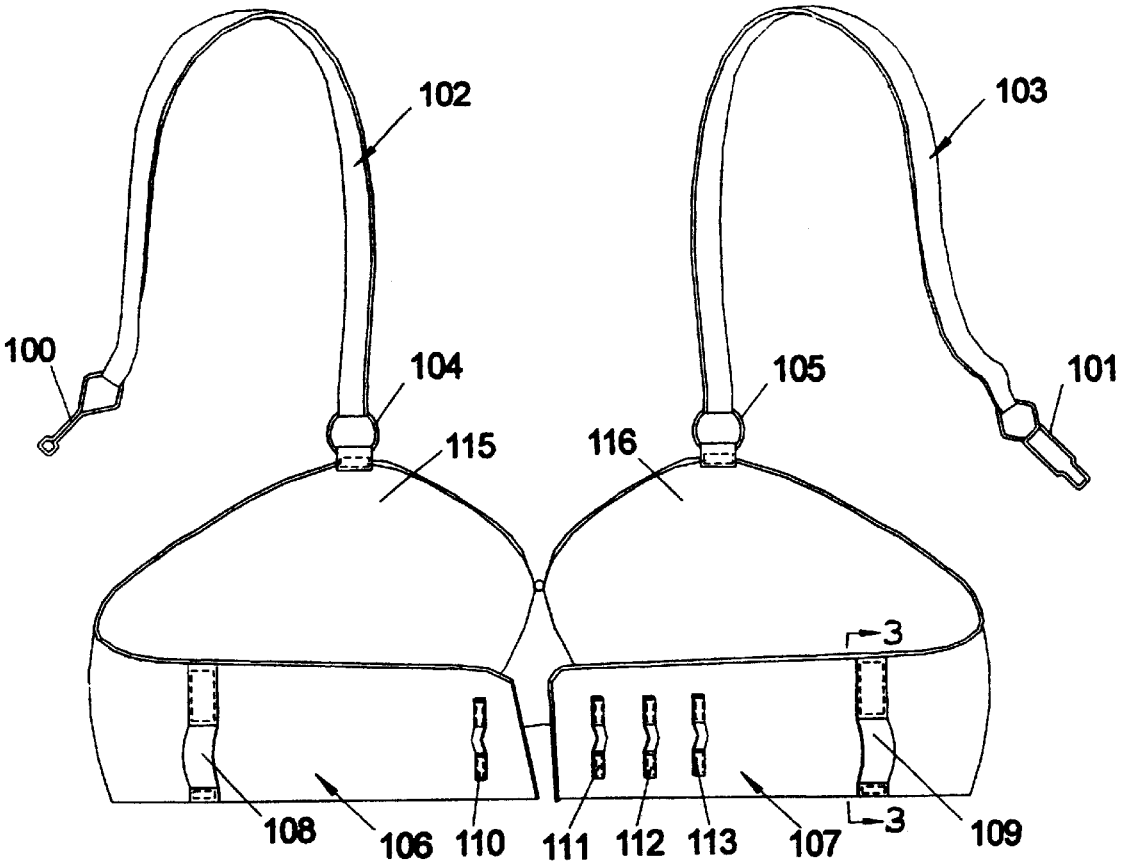
FIGS. 1A and 1B show perspective views of the rear-opening Fall-Away Brassiere of the invention in the unfastened and fastened conditions respectively.
Figure 1B:
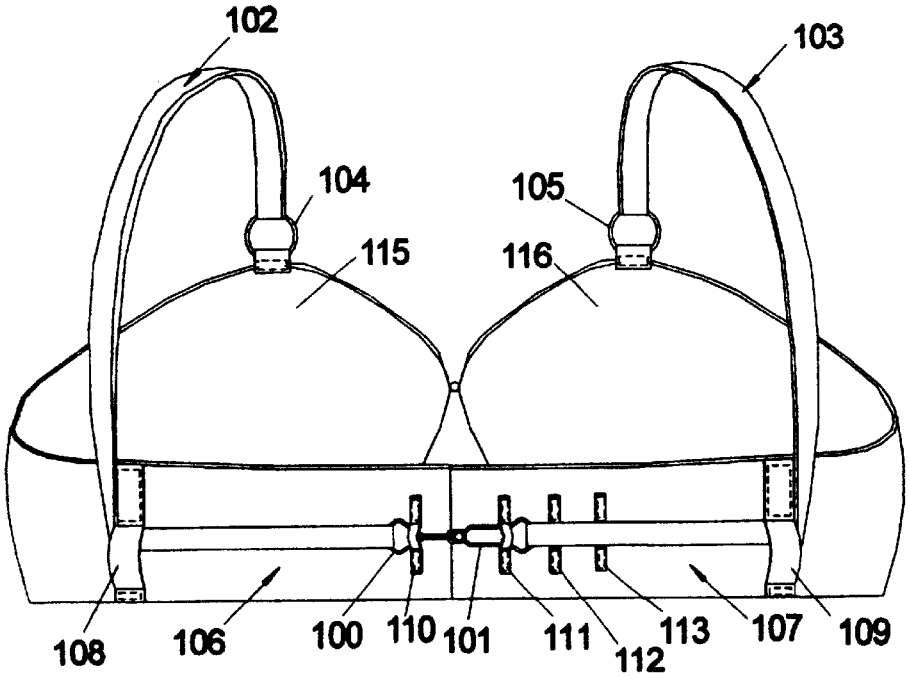

The preferred embodiment of the rear-opening Fall-Away Brassiere is illustrated in FIG. 1A (unfastened view) and FIG. 1B (fastened view). The Fall-Away Brassiere has two shoulder strap assemblies 102 and 103 connected at one end to the top of their respective breast receptor cups 115 and 116 by rings 104 and 105. Shoulder strap assembly 102 has a low-snag hook 100 sewn to its opposite end. Shoulder strap assembly 103 has a low-snag eye 101 sewn to its opposite end. The term "low-snag" is used herein to describe closure units formed as fully closed shapes so as not to damage fabrics. As will be evident to those skilled in the art, the shoulder straps are intended to be provided with means to adjust their lengths, although not illustrated as such.

Back bands 106 and 107 are sewn respectively to the outer edges of breast receptor cups 115 and 116 and are designed to fit around the wearer's back and fasten behind. Two cloth loops 108 and 109 are sewn to the back bands at the point where shoulder straps on a conventional full-support brassiere attach to the back bands. A cloth loop 110 is sewn to the end of back band 106. Cloth loops 111, 112, and 113 are sewn to the end of back band 107.

FIG. 2A (fastened view) and FIG. 2B (unfastened view) show the detail of shoulder strap assemblies 102 and 103 as each engages back bands 106 and 107 respectively and connect to each other at a common point. In order to prevent low-snag hook 100 from passing through cloth loop 110 when being pulled to connect to low-snag loop 101, the height H of the wide end of low-snag hook 100 is significantly greater than the open portion height H' of cloth loop 110. A similar relationship exists between low-snag hook 100 and cloth hooks 111, 112, and 113. FIG. 2B shows how low-snag hook 100 and low-snag eye 101 are free to slide out of cloth loops 110 and 111, 112, or 113 respectively when unfastened from each other.

FIG. 3 shows section 3—3 called out in FIG. 1A of back band 107. A rigid or semi-rigid member 114, designed to prevent back band 107 from bunching up from the tension on cloth loop 109, is stitched into back band 107 directly under cloth loop 109. Back band 106 has an identical rigid member to rigid member 114 (not shown).

FIG. 4 shows an enlarged, detailed, perspective view of low-snag hook 100.

FIG. 5 shows an enlarged, detailed, perspective view of the low-snag eye 101.

Figure 6:
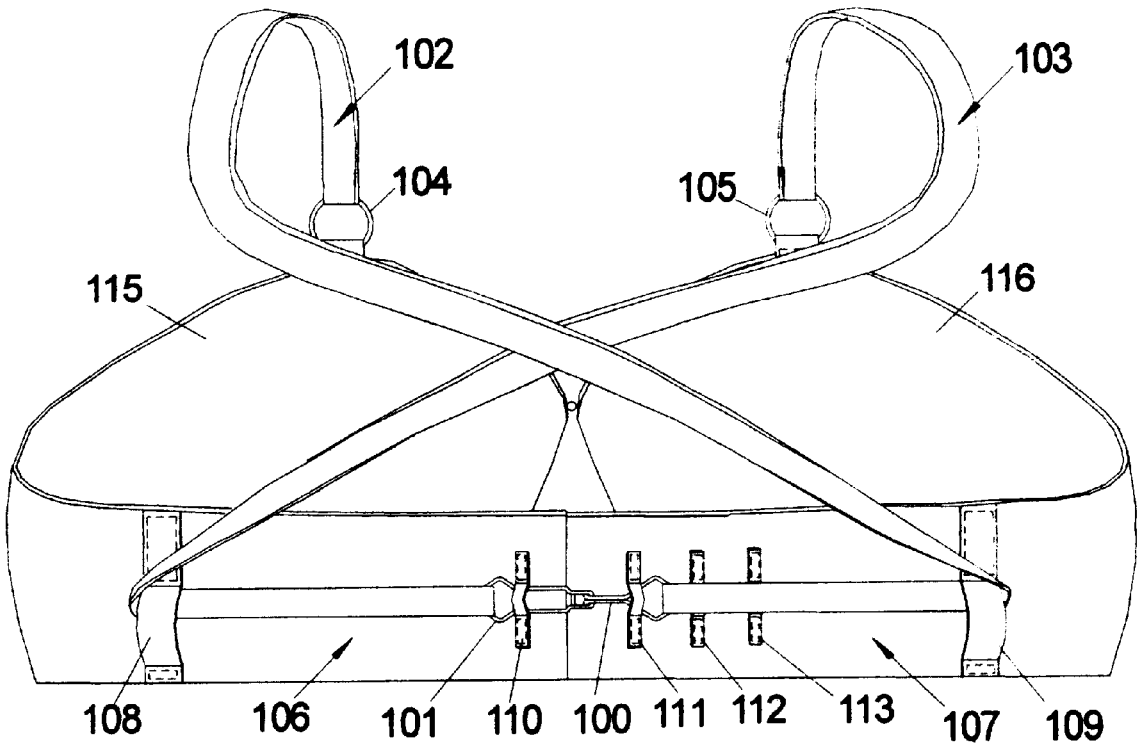
FIG. 6 shows a perspective view of an alternative cross-over strap arrangement for the rear-opening Fall-Away Brassiere.

FIG. 6 illustrates an alternative manner of wearing the Fall-Away Brassiere described in respect to FIGS. 1A, 1B, 2A, and 2B with shoulder strap assemblies 102 and 103 crossed in the back.

Figure 7:
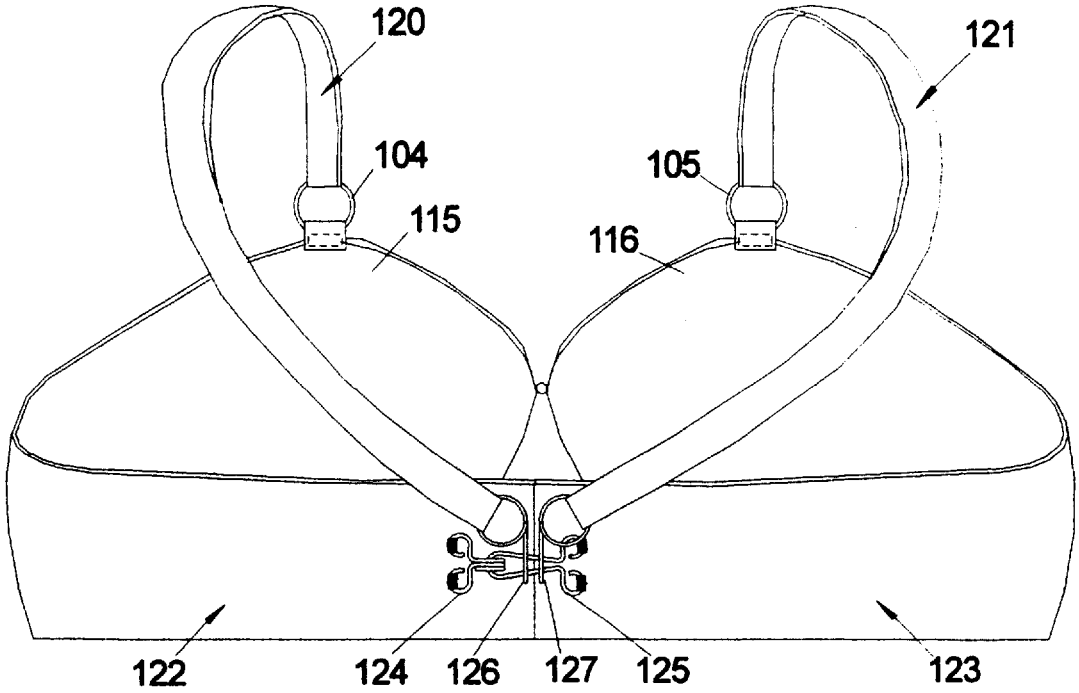
FIG. 7 shows a perspective view of an alternative rear strap arrangement with the shoulder straps connecting directly to the closure in the center of the back band.
Figure 8:
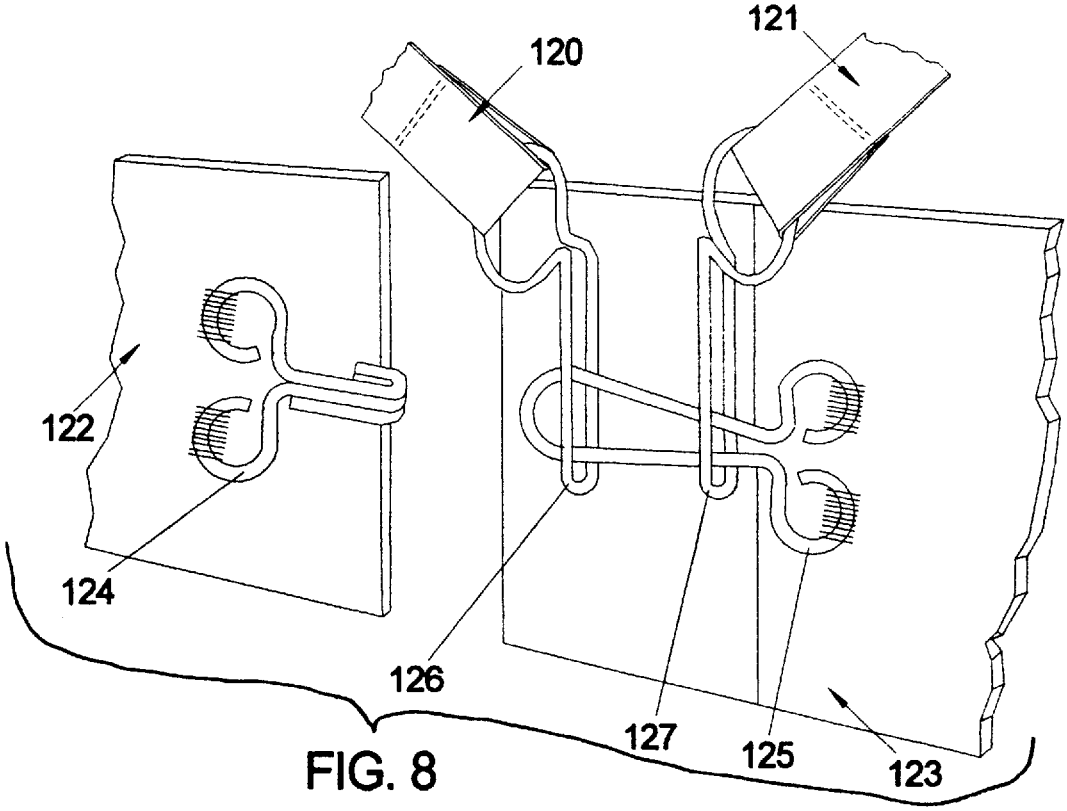
FIG. 8 shows an enlarged, fragmentary, detail view of the closure for the alternative rear strap arrangement shown in FIG. 7 with the shoulder straps connecting directly to the closure in the center of the back band.

FIG. 7 and FIG. 8 illustrate a brassiere employing the conventional front shoulder strap arrangement with shoulder strap assemblies 120 and 121 attached to the top of their respective breast receptor cups 115 and 116 by rings 104 and 105 respectively. Two rings 126 and 127 are connected to the free ends of shoulder strap assemblies 120. and 121 respectively. A conventional hook 124 is sewn to left back band 122 and an eye 125 is sewn to right back band 123. When the brassiere of FIG. 7 is worn, rings 126 and 127 are placed over eye 125 and hook 124 is connected thereto. When hook 124 and eye 125 are disengaged, rings 126 and 127 simultaneously are released, freeing straps 120 and 121.

Figure 9:
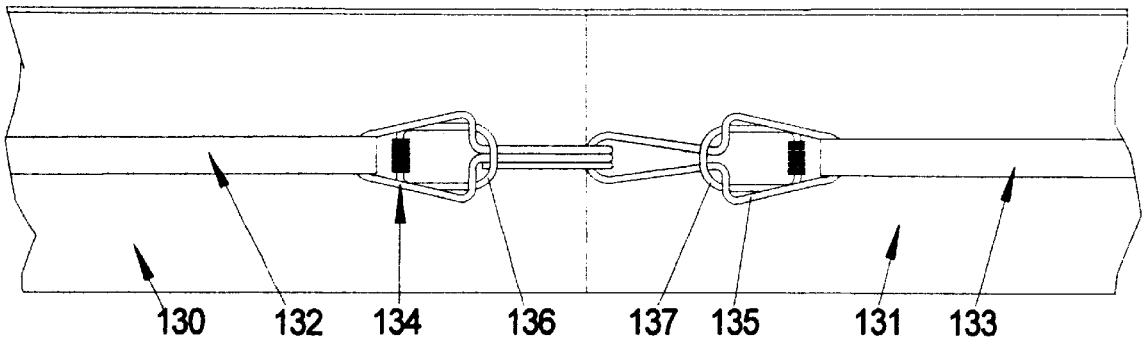
FIG. 9 is an enlarged, fragmentary detail view showing the use of rigid rings in a back closure arrangement.
Figure 10:
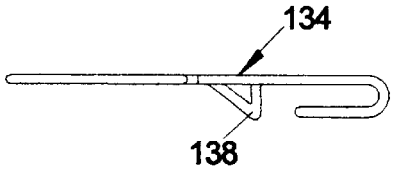
FIG. 10 shows a side view of a hook employing an anti-snag feature.
Figure 11:
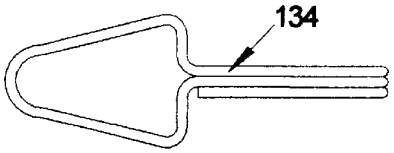
FIG. 11 shows a plan view of an alternative hook employing an anti-snag feature.
Figure 12:
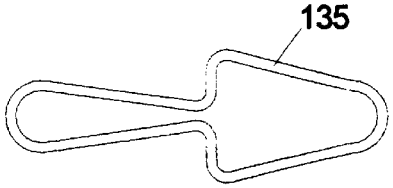
FIG. 12 shows a plan view of an eye for use with the hook of FIG. 11 and employing an anti-snag feature.

FIGS. 9 to 12 show an alternative method and hardware for fastening shoulder strap assemblies 132 and 133 to back bands 130 and 131. In FIG. 9 an eye 135 is passed through a ring 137 made of metal, plastic, cloth or some other suitable material that has been sewn to back band 130. In a similar manner hook 134 employing an 'anti-snag feature 138' is passed through a ring 136 sewn to back band 131 and then hook 134 is fastened to eye 135. Rings 136 and 137 provide similar function as cloth loops 110 and 111 of FIGS. 1A–6.

Figure 13:
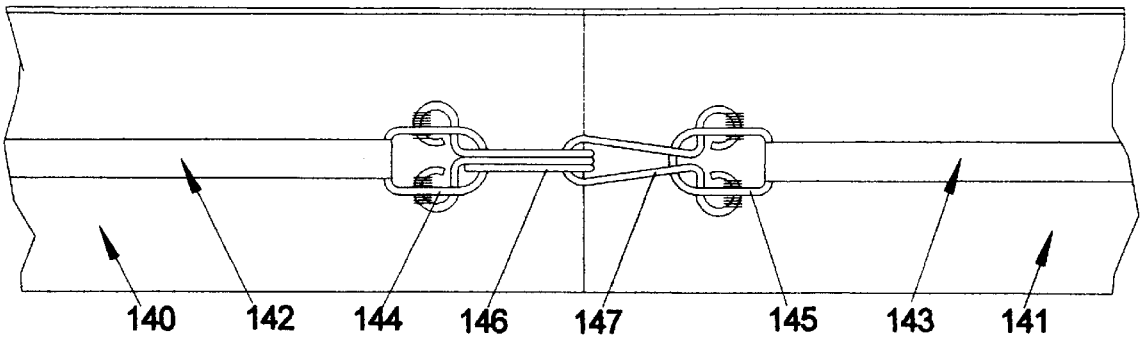
FIG. 13 is an enlarged, fragmentary, detail view showing an alternative arrangement with hook and eye fasteners sewn to the back band and rings attached to the ends of the shoulder straps.

FIG. 13 shows yet an alternative arrangement where a hook 146 and an eye 147 are sewn to back bands 140 and 141 respectively. Rings 144 and 145 are then attached to shoulder strap assemblies 142 and 143 respectively.

Figure 14:
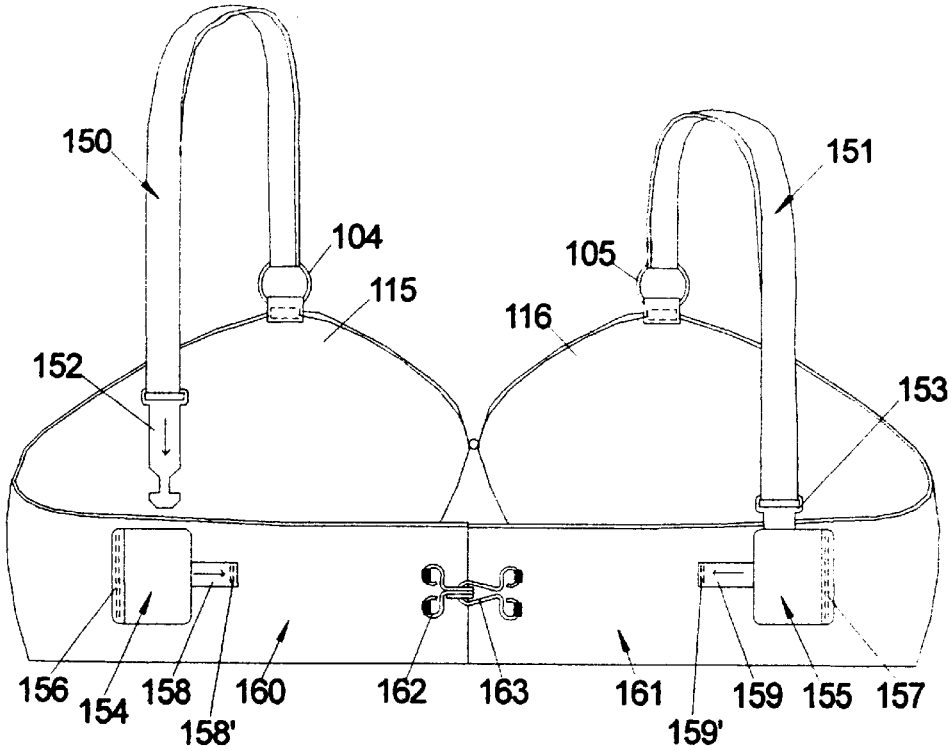
FIG. 14 shows an alternative rear-opening Fall-Away Brassiere that relies on tension in the back band to release the shoulder straps.
Figure 15A:
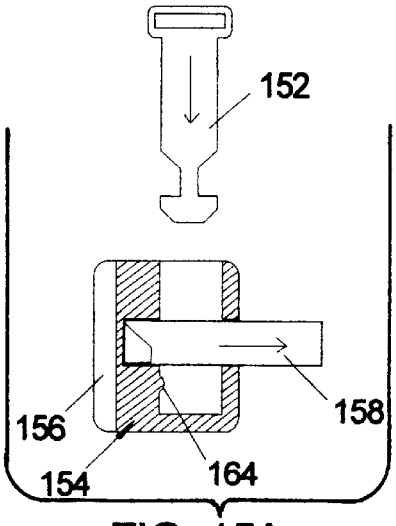
FIGS. 15A through 15C show the latch box detail in various states.
Figure 15B:
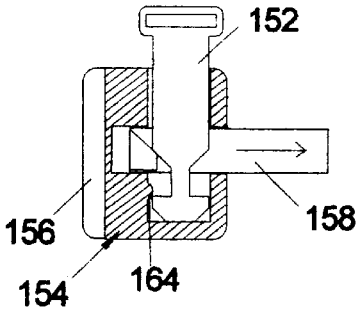

FIGS. 14, 15A, 15B, and 15C illustrate yet another means of constructing the Fall-Away Brassiere. In FIG. 14, two shoulder strap assemblies 150 and 151 are connected at. one end to the top of their respective breast receptor cups 115 and 116 by rings 104 and 105. Shoulder strap clips 152 and 153 are attached to the free end of each shoulder strap assembly 150 and 151. Back bands 160 and 161 are conventional back bands found on commercially available rear release brassieres. A hook 162 is sewn to back band 160 and an eye 163 is sewn to back band 161. Latch boxes 154 and 155 are sewn to back band 160 and 161 respectively through flanges 156 and 157. Protrusions 164 are molded into the wall of latch box 154 and 155 as shown in FIG. 15B. Protrusions 164 are used to secure shoulder strap clips 152 until back bands 160 and 161 are fastened together. Slide dogs 158 and 159 are then sewn to their respective back bands 160 and 161 at flanges 158' and 159' as illustrated in FIG. 14.

Figure 16A:
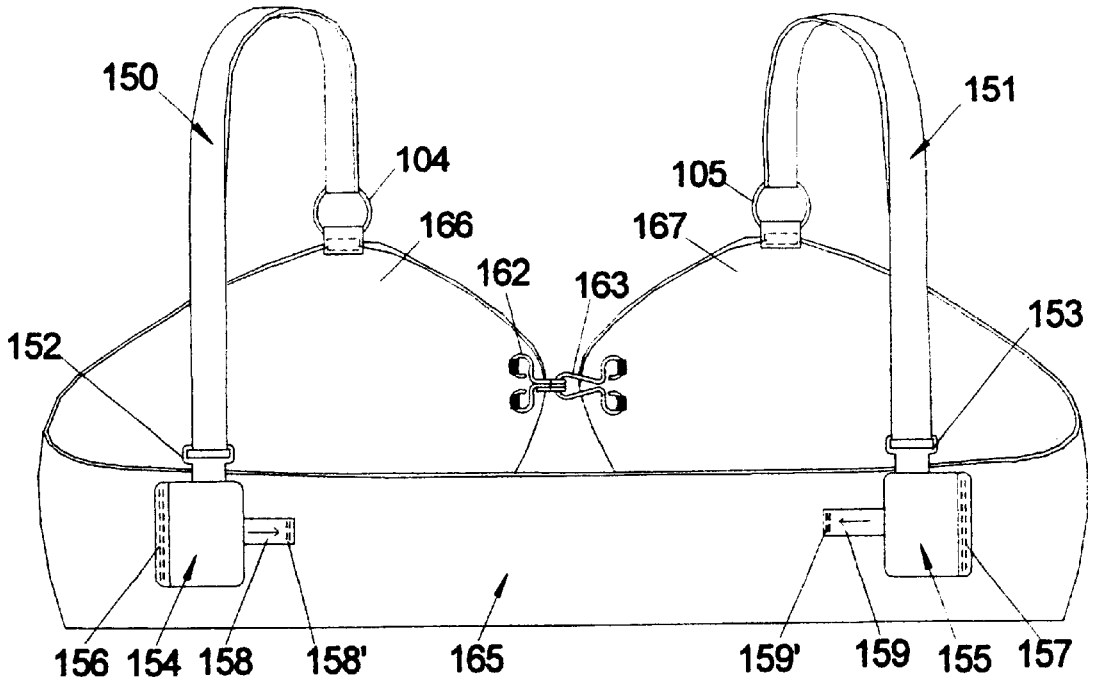
FIGS. 16A and 16B show a front-opening Fall-Away Brassiere in the fastened and unfastened conditions respectively that relies on tension in the back band to release the shoulder straps.
Figure 16B:
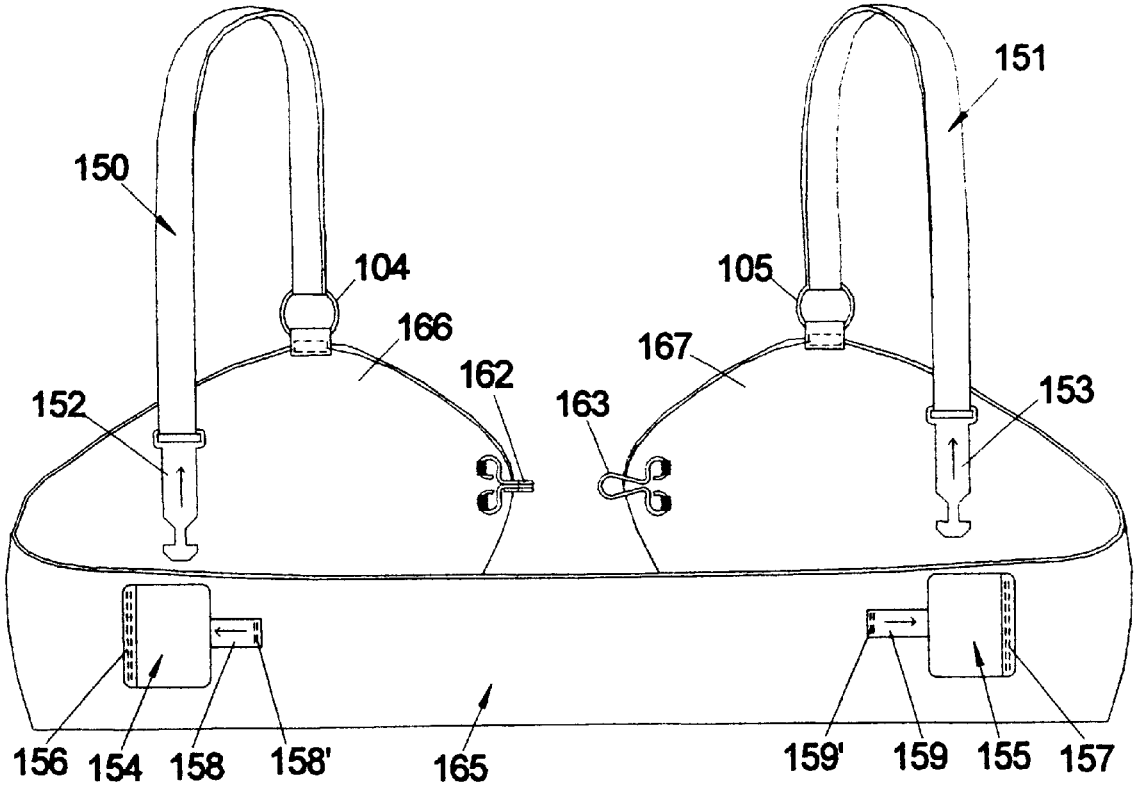

FIGS. 16A and 16B illustrate a front-opening Fall-Away Brassiere similar to the rear-opening brassiere shown in FIG. 14. In FIGS. 16A and 16B shoulder strap assemblies 150 and 151 are connected at one end to the top of their respective breast receptor cups 166 and 167 by rings 104 and 105. Shoulder strap clips 152 and 153 are attached to the free end of each shoulder strap assembly 150 and 151. Back band 165 is a conventional elastic back band found on commercially available front-opening brassieres. A hook 162 and an eye 163 are sewn to juxtaposed central portions of breast receptor cups 166 and 167. Latch boxes 154 and 155 are sewn to back band 165 through flanges 156 and 157 respectively. Slide dogs 158 and 159 are sewn to back band 165 as illustrated in FIGS. 16A and 16B.

Figure 17A:
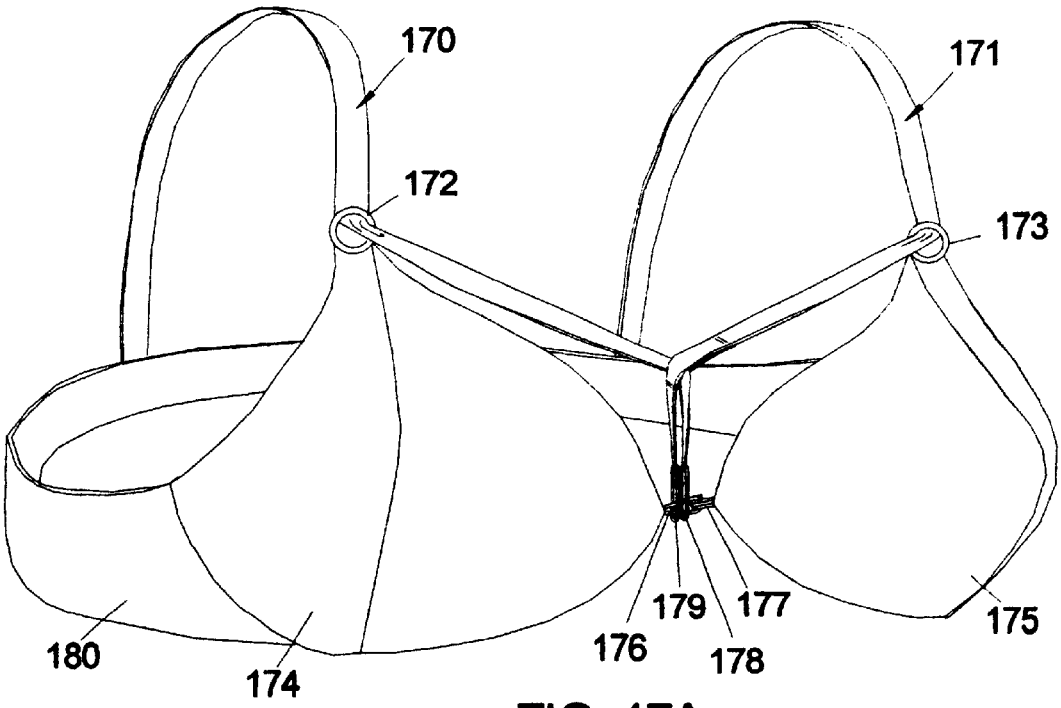
FIGS. 17A and 17B show perspective views of a front-opening Fall-Away Brassiere. in the fastened and unfastened conditions respectively.
Figure 17B:
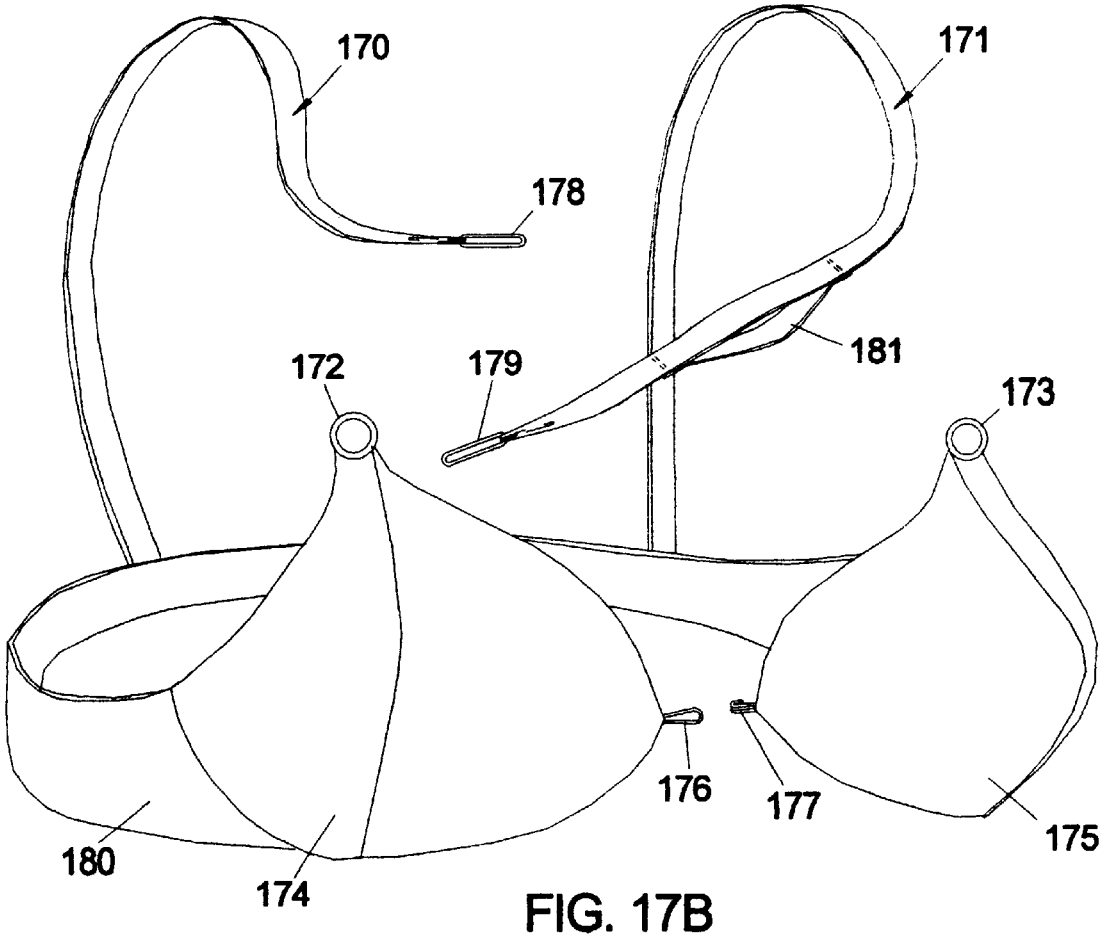

FIGS. 17A and 17B show the preferred embodiment of the front-opening Fall-Away Brassiere where both the back band and shoulder straps release in the front. In FIG. 17A shoulder strap assemblies 170 and 171 are sewn to a back band 180 in the rear. Shoulder strap assembly 171 has a shoulder strap slit 181 (see FIG. 17B) near its free end. Breast receptor cups 174 and 175 are sewn to either end of back band 180. An eye 176 is sewn to breast receptor cup 174. A hook 177 is sewn to breast receptor cup 175. Shoulder strap rings 178 and 179 are attached to the free ends of shoulder straps 170 and 171 respectively.

FIGS. 18A, 18B and 19A to 19E illustrate a front-opening Fall-Away Brassiere with a remote-release mechanism 200. Two shoulder strap assemblies 190 and 191 are sewn to a back band 198. Two shoulder strap clips 192 and 193 are connected to the free ends of shoulder strap assemblies 190 and 191. Breast receptor cups 196 and 197 are sewn to either end of back band 198. A hook 162 is sewn to the front of breast receptor cup 197. An eye 163 is sewn to the front of breast receptor cup 196. Remote-release mechanism 200 is comprised of a latch box 194 sewn to the front of breast receptor cup 196, a flexible tube 202 made of plastic or some other semi-rigid material, and a cord 199. Latch box 194, seen in detail in FIGS. 19A–19E, is comprised of a wedge 204, a spring 203, a catch 205 and a protrusion 206. Wedge 204 is attached to one end of cord 199. The other end of cord 199 is attached to the elastic portion of back band 198. In a like manner, a latch box 195 is attached to breast receptor cup 197.

DETAILED OPERATION OF THE PREFERRED EMBODIMENTS OF THE INVENTION

FIGS. 1A, 1B, 2A, 2B, 3, 4, 5, and 6

The preferred embodiment of the rear-opening Fall-Away Brassiere is illustrated in FIG. 1A (unfastened view) and FIG. 1B (fastened view). To don the brassiere, the wearer laces shoulder strap assembly 102 through loop 108. Low-snag hook 100 is then slid part way through cloth loop 110. In a like manner shoulder strap assembly 103 is laced through cloth loop 109. Low-snag eye 101 is then slid part way through cloth loop 111, 112, or 113 depending on the desired size. The wearer then slides the brassiere around her back and fastens low-snag hook 100 to low-snag eye 101. The brassiere is now securely fastened around the back of the wearer. Shoulder strap assemblies 102 and 103 are then slid onto the shoulders.

Alternatively, the wearer may elect to cross shoulder strap assemblies 102 and 103 in back as shown in FIG. 6. Such an arrangement is common when wearing a sleeveless dress, since it helps keep shoulder strap assemblies 102 and 103 on the shoulder of the wearer. To wear the Fall-Away Brassiere with the shoulder strap assemblies crossed, low-snag hook 100 is now slid through cloth loop 109 and cloth loops 111, 112, or 113. Low-snag eye 101 is slid through cloth loop 108 and cloth loop 110.

The advantage of the Fall-Away Brassiere is apparent when the wearer wishes to remove the brassiere without having to first remove outer garments. To remove the Fall-Away Brassiere shown in FIGS. 1A to 6, the wearer reaches up under her blouse and unfastens low-snag hook 100 from low-snag eye 101. Back bands 106 and 107 are immediately released and shoulder strap assemblies 102 and 103 are free to slide out of their respective cloth loops 108 and 109; thus allowing the brassiere to fall away from the body of the wearer. The wearer can then slide the brassiere out from under her blouse.

FIGS. 7 and 8

An alternative version of a rear-opening Fall-Away Brassiere is shown in FIGS. 7 and 8 whereby shoulder strap assemblies 120 and 121 are connected directly to the center of the back bands 122 and 123. The advantages of this design over the design illustrated in FIGS. 1A and 1B is the ease with which the wear can don this version of the Fall-Away Brassiere. The wearer first slips eye 125 through rings 127 and 126. Next she slides the brassiere around her waist and fastens hook 124 to eye 125, securing shoulder strap assemblies 120 and 121 to back bands 122 and 123 at a common point. Shoulder strap assemblies 120 and 121 are then slid onto the shoulders.

The Fall-Away Brassiere shown in FIG. 7 is removed in a similar manner to the Fall-Away Brassiere in FIGS. 1A and 1B. The wearer reaches up under her blouse and unfastens hook 124 from eye 125. Shoulder straps 120 and 121 are immediately released and are free to slide off the wearer's shoulders; thus allowing the brassiere to fall away from the body of the wearer. The wearer can then slide the brassiere out from under her blouse.

FIGS. 9 to 12

FIG. 9 illustrates a version of the invention that operates in the same manner as the brassiere described in FIGS. 1A and 1B. The differences are in the details of the fastener design and the materials used for the fasteners. FIG. 9 shows the use of rings 136 and 137 in place of the cloth loops 110, 111, 112, and 113 shown in FIG. 1A. An additional difference is the use of hook 134 with the anti-snag feature 138 in place of low-snag hook 100 and low-snag eye 101.

FIG. 13

The brassiere closure of FIG. 13 differs slightly from that of FIG. 9 in that hook 146 and eye 147 are sewn to back bands 140 and 141 respectively. Rings 144 and 145 are then attached to the free ends of shoulder strap assemblies 142 and 143 respectively. To don the brassiere, eye 147 is slid through ring 145. Hook 146 is slid through ring 144 and fastened to eye 147 securing the brassiere around the wearer.

To remove the brassiere, the wearer unfastens hook 146 from eye 147. Rings 144 and 145 are then free to slide off hook 146 and eye 147 respectively; thus releasing the shoulder straps so the brassiere can be readily removed.

FIGS. 14, 15A, 15B, 15C, 16A, 16B

Figure 15C:
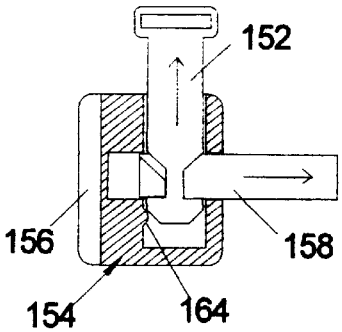

To don the Fall-Away Brassiere in FIG. 14, the wearer inserts shoulder strap clips 152 and 153 into latch boxes 154 and 155 respectively. Shoulder strap clips 152 and 153 are pushed past protrusions 164 shown in FIG. 15B, temporarily holding shoulder strap assemblies 150 and 151 in place while the wearer fastens the back bands 160 and 161. around her back. Once back bands 160 and 161 are fastened together, the elastic in the back bands stretches and pulls slide dogs 158 and 159 into a closed position shown in FIG. 15B. The wearer then slips shoulder strap assemblies 150 and 151 onto her shoulders, causing shoulder strap clips 152 and 153 to pull past protrusions 164. At this point shoulder strap clips 152 and 153 are secured by slide dogs 158 and 159 as shown in FIG. 15C.

To remove the brassiere, the wearer unfastens hook 162 from eye 163. When the tension in back hands 160 and 161 is released, slide dogs 158 and 159 are forced into the open position by the elastic in the back bands. Shoulder strap clips 152 and 153 are free to slide out of their respective latch boxes 154 and 155. The brassiere is then free to 'fall-away' from the wear's body.

The Fall-Away Brassiere illustrated in FIGS. 16A and 16B operates in a similar manner to the embodiment shown in FIG. 14. The difference is that FIG. 14 shows a rear-opening brassiere while the brassiere illustrated in FIGS. 16A and 16B is a front-opening brassiere.

FIGS. 17A and 17B

To don the front-opening Fall-Away Brassiere shown in FIGS. 17A and 17B the wearer first laces shoulder strap assembly 171 through ring 173. Next shoulder strap assembly 170 is laced through ring 172. The wearer then slides back band 180 around her back and slides shoulder strap assembly 170 through shoulder strap slit 181. Eye 176 is then passed through shoulder strap rings 179 and 178 and attached to hook 177; thus securing the brassiere. Shoulder strap assemblies 170 and 171 are then slipped onto the wear's shoulders.

Like all the previous Fall-Away Brassieres disclosed herein, this one can also be removed without having to first remove any outer garments. To remove the Fall-Away Brassiere shown in FIGS. 17A and 17B, the wearer reaches up under the front of her blouse and unfastens hook 177 from eye 176. Shoulder strap rings 178 and 179 are free to slide off hook 176 and through rings 172 and 173 respectively, thus allowing the brassiere to fall away from the body of the wearer. The wearer can then slide the brassiere out from under her blouse.

FIGS. 18A, 18B, 19A, 19B, 19C, 19D, 19E

Figure 18A:
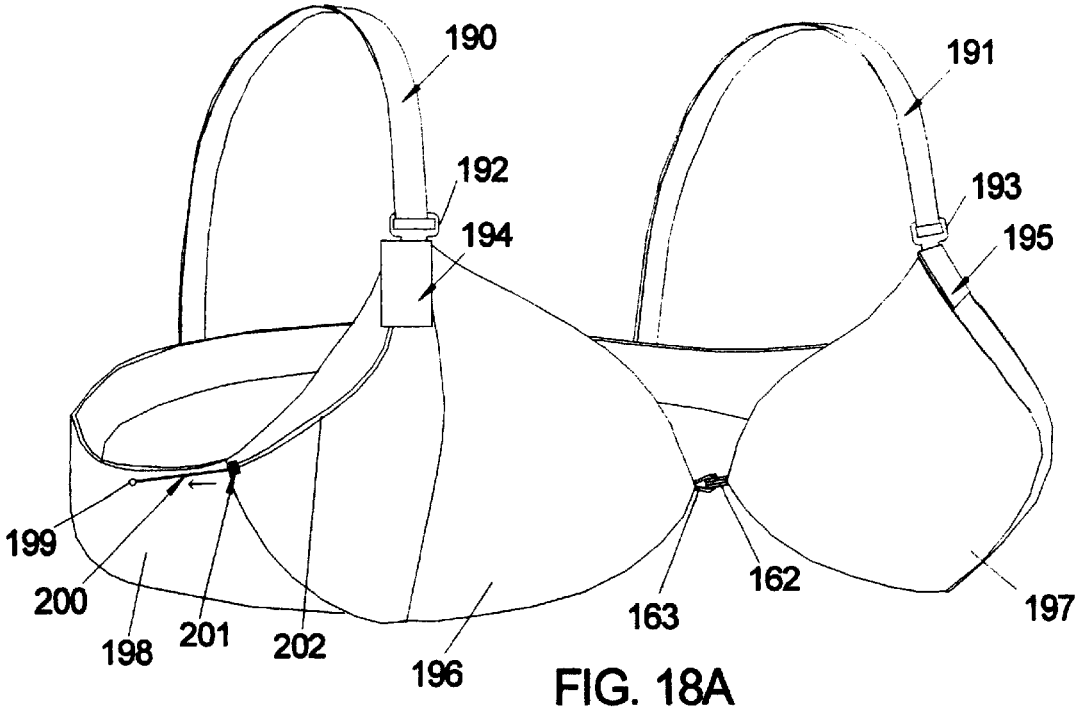
FIGS. 18A and 18B show perspective views of a front-opening Fall-Away Brassiere that relies on a remote release device to release the front of the shoulder straps.
Figure 18B:
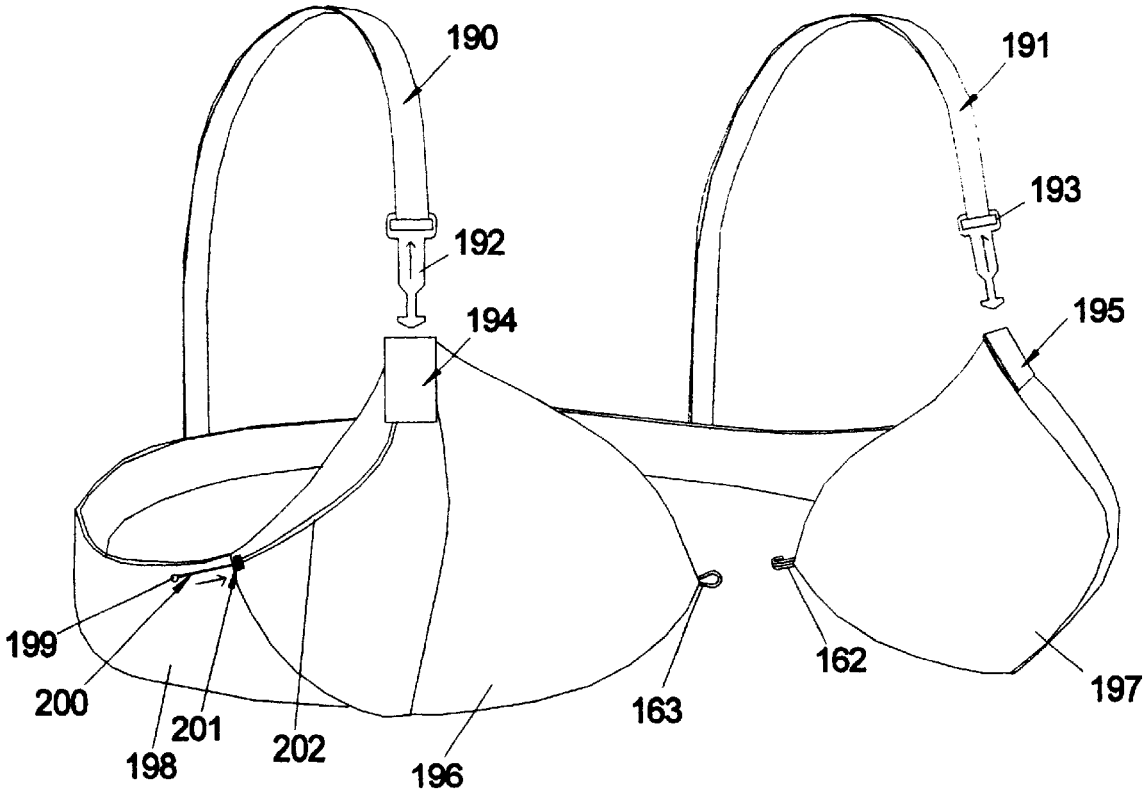
Figure 19A:
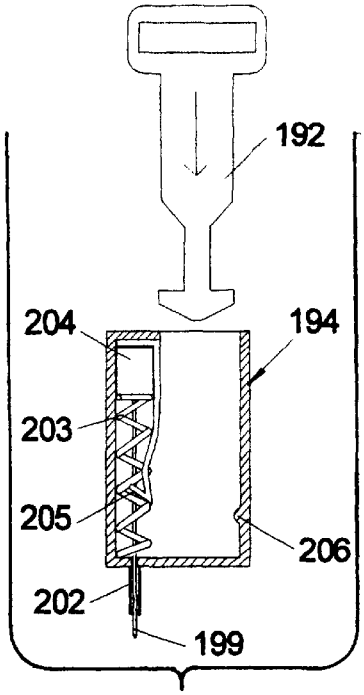
FIGS. 19A through 19E show detailed drawings of the remote release mechanism in various states of operation.
Figure 19B:
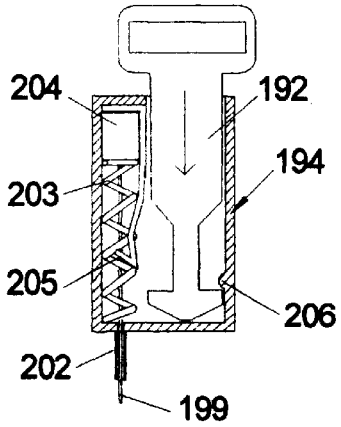
Figure 19C:
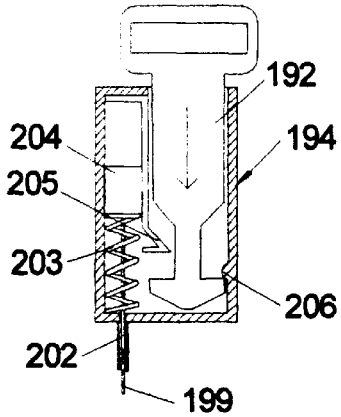
Figure 19D:
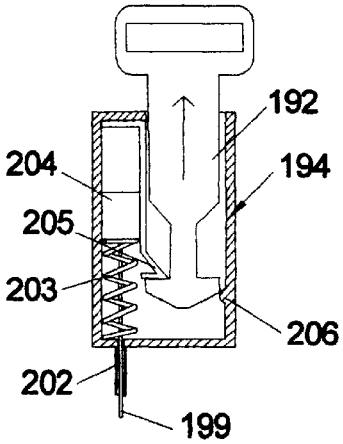

To don the front-opening Fall-Away Brassiere illustrated in FIGS. 18A and 18B, the wearer first inserts shoulder strap clip 192 into latch box 194. Shoulder strap clip 192 is held temporarily in place by protrusion 206 as illustrated in FIG. 19B. In a similar manner, shoulder strap clip 193 is inserted into latch box 195. The wearer now slips the brassiere on like a vest and fastens hook 162 into eye 163 with the back band around her back. This tensioning of the back band causes cord 199 to pull wedge 204 down, compressing spring 203 and forcing catch 205 out of its relaxed position into the closed position as illustrated in FIG. 19C. The wearer now slips shoulder strap assemblies 190 and 191 onto her shoulders, causing shoulder strap clips 192 and 193 to move past protrusion 206 and be held securely only by catch 205 as illustrated in FIG. 19D.

Figure 19E:
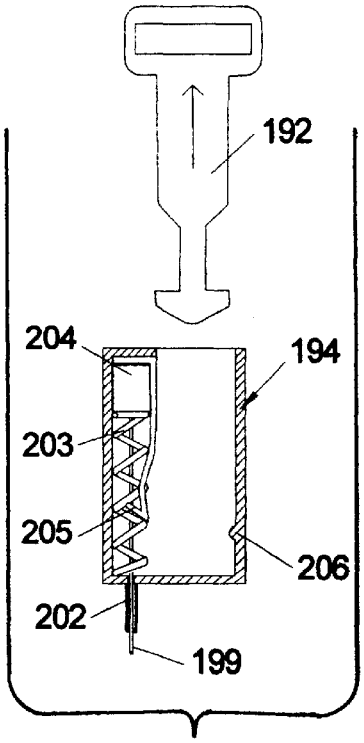

To remove the Fall-Away Brassiere shown in FIGS. 18A and 18B, the wearer reaches up under the front of her blouse and unfastens hook 162 from eye 163 thereby releasing the tension in the back band. Cord 199 is no longer under tension and can no longer hold wedge 204 in the down position. Spring 203 pushes wedge 204 up, allowing catch 205 to return to the released position as illustrated in FIG. 19E. Shoulder strap clips 192 and 193 are free to slide out of latch boxes 194 and 195 respectively; thus allowing the brassiere to fall away from the body of the wearer. The wearer can then slide the brassiere out from under her blouse.

Thus the reader can see that the Fall-Away Brassiere described in the above specification provides a full-support brassiere that offers the convenience of removal previously available only in strapless brassieres. Furthermore, the Fall-Away Brassiere has the additional advantages in that:

(a) it provides full support for the breasts through the use of shoulder straps, avoiding the need for underwires;

(b) it allows the wearer the option of removing the brassiere without the need to first remove the dress or blouse;

(c) it permits the wearer to selectively cross the straps in back when wearing a sleeveless top;

(d) it employs fasteners that fasten and unfasten in a conventional manner; and (e) it requires relatively few design modifications in comparison to commercially available brassieres.

While my above description contains many features, these should not be construed as limitations on the scope of the invention, but rather as an exemplification of preferred embodiments thereof Many other variations are possible. For example, the fasteners can be made of many different materials such as steel, brass, plastic, VELCRO®, etc. and can take many different shapes to prevent snagging. Low-snag hook 100 and low-snag eye 101, illustrated in FIGS. 5 and 6, are meant to show just one method of fastening the brassiere and not an attempt to show all the countless possible variations. Cloth loops 108, 109, 110, 111, 112, and 113 can be made of steel, plastic, or any other suitable material; can be attached at many different locations on the back bands; and can be attached to the back bands using numerous methods such as snaps, buttons, glue, stitching, rivets, etc. Furthermore, it is not necessary that cloth loops 108 and 109 span back bands 106 and 107 as shown in FIGS. 1A and 1B. Cloth loops 108 and 109 can be connected only to the top edge of back bands 106 and 107; however, the function and operation remains unchanged.

Accordingly, the scope of the invention should be determined not by the embodiments illustrated, but by the appended claims and their legal equivalents.

What is claimed is:

1. A fall-away brassiere, comprising:

(a) a first breast receptor cup;

(b) a first back band portion connected to an outer edge of the first breast receptor cup, (c) a second breast receptor cup connected at an inner edge thereof to an inner edge of the first breast receptor cup;

(d) a second back band portion connected to an outer edge of the second breast receptor cup;

(e) a first strap connected at a front end thereof to an upper edge of the first breast receptor cup;

(f) a second strap connected at a front end thereof to an upper edge of the second breast receptor cup;

(g) a first loop connected to the first back band portion and being configured to receive the first strap therethrough;

(h) a second loop connected to the second back band portion and being configured to receive the second strap therethrough;

(i) a first connector connected to a back end of the first strap; and (j) a second connector connected to a back end of the second strap and being configured to releasably engage the first connector.

2. The fall-away brassiere as described in claim 1, wherein the first connector is a hook and the second connector is an eye.

3. The fall-away brassiere as described in claim 1, wherein the first strap is passed through the first loop and the second strap is passed through the second loop when the brassiere is worn.

4. The fall-away brassiere as described in claim 1, wherein the first strap is passed through the second loop and the second strap is passed through the first loop when the brassiere is worn.

5. The fall-away brassiere as described in claim 1, wherein the first and second loops are connected to the first and second back portions at positions distal from a juncture between the first and second back portions and further comprising a third loop positioned on the first back portion adjacent the juncture and a fourth loop positioned on the second back portion adjacent the juncture.

6. The fall-away brassiere as described in claim 5, wherein the hook and the eye are each connected to a respective strap and a narrow end and the first and second loops are sized to allow the hook and the eye to pass completely therethrough and the third and fourth loops are sized to allow a narrow end to pass and to prevent a wide end of the hook and eye from passing therethrough.

7. The fall-away brassiere as described in claim 5, further comprising a rigid member assembled to each back band adjacent each of the first, second, third, and fourth loops.

8. A fall-away brassiere, comprising:

(a) a first breast receptor cup;

(b) a first back band portion connected to an outer edge of the first breast receptor cup;

(c) a second breast receptor cup connected at an inner edge thereof to an inner edge of the first breast receptor cup;

(d) a second back band portion connected to an outer edge of the second breast receptor cup;

(e) a first strap connected at a front end thereof to an upper edge of the first breast receptor cup;

(f) a second strap connected at a front end thereof to an upper edge of the second breast receptor cup;

(g) a first connector ring connected to a back end of the first strap;

(h) a second connector ring connected to a back end of the second strap;

(i) a hook attached to the first back portion;

(j) a loop attached to the second back portion and adapted to be engaged by the hook; and (k) wherein the first and second connector rings are configured to be entrained on the hook and eye when engaged.

9. A fall-away brassiere, comprising:

(a) a first breast receptor cup;

(b) a back band portion connected at a first end thereof to an outer edge of the first breast receptor cup;

(c) a second breast receptor cup connected at an outer end thereof to a second end of the back band portion;

(d) a first strap connected at a back end thereof to an upper edge of the back band portion;

(e) a second strap connected at a back end thereof to an upper edge of the back band portion;

(f) a first connector ring connected to a front end of the first strap;

(g) a second connector ring connected to a front end of the second strap;

(h) a hook attached to the first breast receptor cup;

(i) a loop attached to the second breast receptor cup and adapted to be engaged by the hook; and (j) wherein the first and second connector rings are configured to be entrained on the hook and eye when engaged.

10. A brassiere comprising:

a pair of breast receptor cups;

a back band attached to each of the breast receptor cups;

a pair of shoulder straps, each shoulder strap having a first end and a second end, wherein one of either the first end or second end is attached to either the back band or one of the pair of breast receptor cups; and a releasable clasp connecting the pair of shoulder straps to the back band or the pair of breast receptor cups so that when the releasable clasp is released, the back band or pair of breast receptor cups, and at least one end of each of the shoulder straps are simultaneously released.

* * * * *